United States Patent [19]

Tortil

[11] 3,977,950

[45] Aug. 31, 1976

[54] PROCESS AND APPARATUS FOR COLLECTION OF GASES

[75] Inventor: Pierre Tortil, Saint-Jean-de-Maurienne, France

[73] Assignee: Aluminum Pechiney, Lyon, France

[22] Filed: Jan. 17, 1975

[21] Appl. No.: 542,034

[30] Foreign Application Priority Data

Feb. 28, 1974 France ..... 74.06756

[52] U.S. Cl. ..... 204/67; 204/243 R; 204/246; 204/247

[51] Int. Cl.[2] ..... C25C 3/06; C25C 3/14

[58] Field of Search ..... 204/67, 247, 278, 243 R, 204/243 M, 245, 246

[56] References Cited

UNITED STATES PATENTS

| | | | |
|---|---|---|---|
| 3,207,681 | 9/1965 | Sem | 204/67 |
| 3,470,075 | 9/1969 | Johnson | 204/67 |
| 3,729,399 | 4/1973 | Kibby | 204/67 |

*Primary Examiner*—John H. Mack
*Assistant Examiner*—A. C. Prescott
*Attorney, Agent, or Firm*—Dennison, Dennison, Meserole & Pollack

[57] ABSTRACT

A process and apparatus for the collection of the gases from a tank for the production of aluminum by igneous electrolysis. In the process, the crust that covers the electrolytic solution is pierced, the hole thus obtained is kept open and the gases flowing from it are collected. The invention applies to alumina igneous electrolysis tanks and, more specifically, to tanks making use of preheated multiple anodes.

7 Claims, 6 Drawing Figures

PROCESS AND APPARATUS FOR COLLECTION OF GASES

The present invention consists of a process and apparatus for the collection of the gases from a tank for the production of aluminum by igneous electrolysis.

Practice of the invention makes possible an increase in the effectiveness of the collection, a simplification of the purification systems and a decrease in atmospheric pollution.

The problem of collecting and purifying the gases produced in the course of the electrolysis of aluminum is becoming more and more acute as a result of the increases in the size of the production facilities and of advances in knowledge concerning pollution.

These gases that are produced in an amount ranging between 0.05 and 0.08 liters per second per tank and per one thousand amperes, essentially are composed of a mixture of carbon gas and carbon monoxide, originating from the oxidation of the anode by the oxygen released by the electrolysis, to which are added oxygenated sulphur compounds, originating from the sulphur contained in the anode, fluorine compounds originating from the solution and powders mainly composed of particles of alumina, together with, in the case of Soderberg anodes, soot and tar originating from the cooking of the paste.

The known method is to collect such gases at the roof of the facility, which is relatively gas-proof and provided with air inlets at the base of the walls. This process requires handling of very large volumes of gas, of the order of 100 to 120 liters per second, per tank and per 1000 amperes, which requires cumbersome installations and, since the gases are greatly diluted, their purification is relatively difficult.

It is also possible to place a cover above each tank. This makes it possible to collect smaller volumes of gas (approximately 11 to 12 liters per second, per tank and per 1000 amperes), and therefore less diluted, which renders their further treatment easier, but at the price of significant mechanical complication, because these covers, that have a complex shape to permit the passage of the current intakes, must also be disassembled in order to be able to break the crust that forms on the tank and to add alumina.

Anyone who has had occasion to observe tanks for the electrolysis of aluminum in operation will note that in some places a hole is formed through the solid crust that covers the tank, and through such hole there takes place a release of gases that burn on the surface of the crust, and it might have appeared to be logical to collect the fumes thus produced by placing a collecting funnel above the hole, collecting it with a suction device. Unfortunately, these holes appear in a totally unpredictable manner at any place in the tank, become clogged after a variable period of time and are usually destroyed when the crust is broken in order to let alumina into the tank.

This invention consists of a process for the collection of gases from a tank for the production of aluminum by igneous electrolysis and an apparatus for the practical application of this process.

In the process envisaged by the invention, the crust that covers the tank for electrolysis is pierced, the hole thus formed is kept open, the gases flowing from it are collected and air is mixed with these gases.

The apparatus envisaged by the invention includes a movable shaft capable of opening a hole in the crust that covers the electrolytic tank and of keeping it open, and a fixed collecting hood placed above such hole, covering it, and connected to a pipe collecting the gas. An air intake is provided in the vicinity of the lower end of the hood.

The invention described above is best illustrated by reference the the drawings, wherein FIG. 1 shows a tank fitted with the collecting device in lateral elevation on the right-hand side, and, on the lefthand side in section by a vertical plane along its axis;

In the figures, the same components are designated by the same reference characters.

Unexpectedly and surprisingly, it appears that a single apparatus is sufficient to collect nearly all the gases produced in the tank, that is, 80 to 90% of the CO and $CO_2$ gases, calculated from the loss of carbon from the anodes.

The fraction of the gas that is not collected may correspond in part to the gases dispersed by filtration through the pores of the crust or of the anode and to those that escape when the crust is broken, and in part to the direct combustion of the anode in contact with the air, above the tank. The latter fraction may be regarded as contributing little to pollution because it does not contain fluorine compounds.

In order to explain this surprising behavior, it must be assumed that, between the tank and the crust and around the anodes, a cavity filled with gas is formed and such cavity, far from being partitioned, forms a single chamber that serves as a collecting point for the gases. Of course, however, nothing prevents placing several collection devices over a single tank if desired.

The collection apparatus must include a fresh air inlet for the purpose of burning CO into $CO_2$ because of its toxicity, and for cooling the hot gases. A total air flow, including the gases produced, of the order to 0.8 liter per second (corrected for standard conditions, that is, 0°C and 1 atmosphere), per 1000 amperes of intensity, that is a dilution of the gases by approximately 10 times, has been found to be appropriate.

The hole in the crust must be permanently kept open, for example by inserting into it from time to time a steel shaft. It has been found that, if this operation is repeated every 4 hours, the average collection efficiency is only approximately 50%, while it reaches 80 to 90% if it is repeated approximately every 10 minutes.

The apparatus shown in the illustrations is fitted to a tank with preheated multiple anodes, but it would also apply equally well to a tank with a continuous single anode of the so-called Soderberg type. Then, it could be placed between the anode and the case of the tank.

Figure 1:
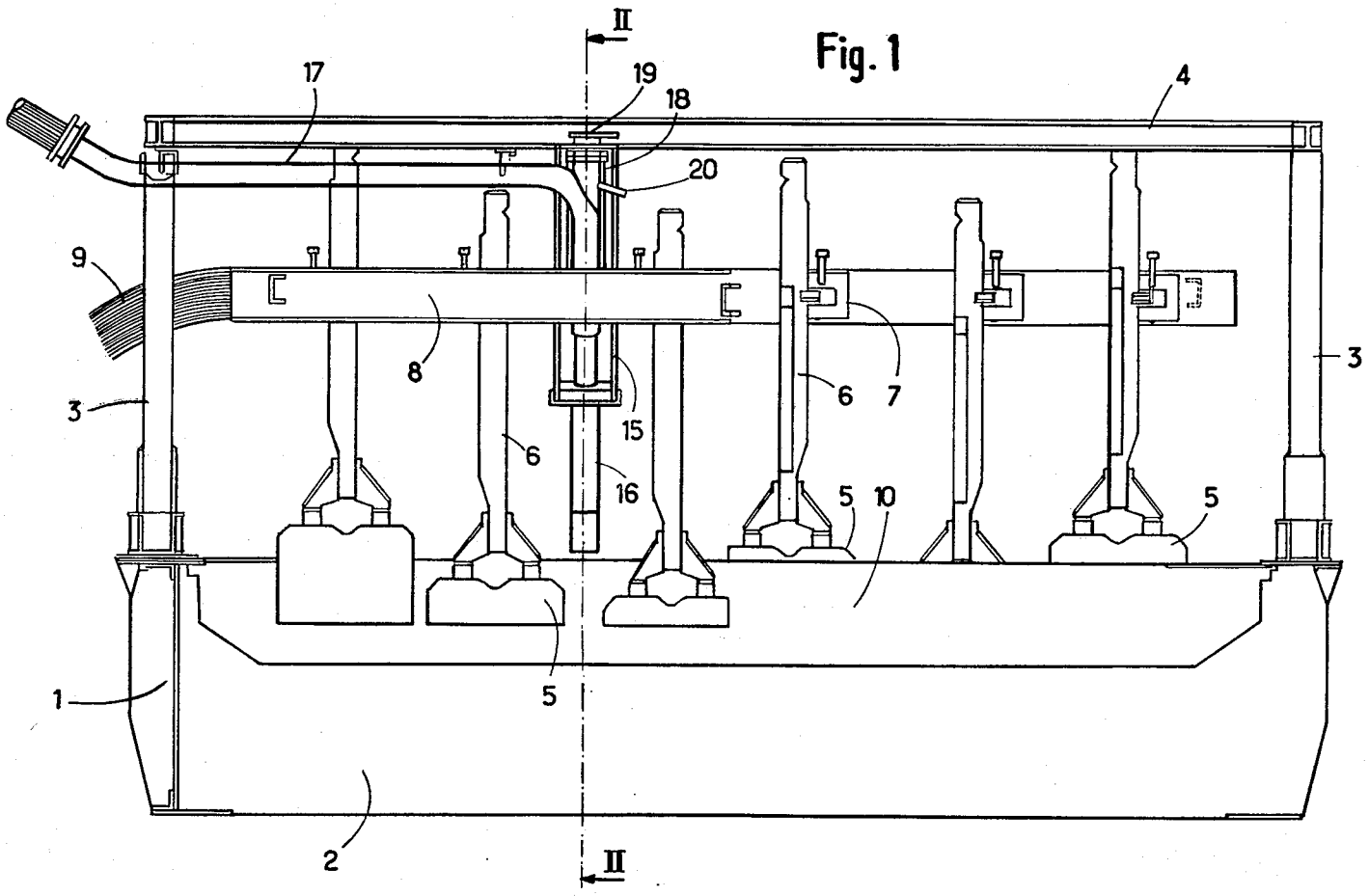
Figures 2, 3, 4, 5:
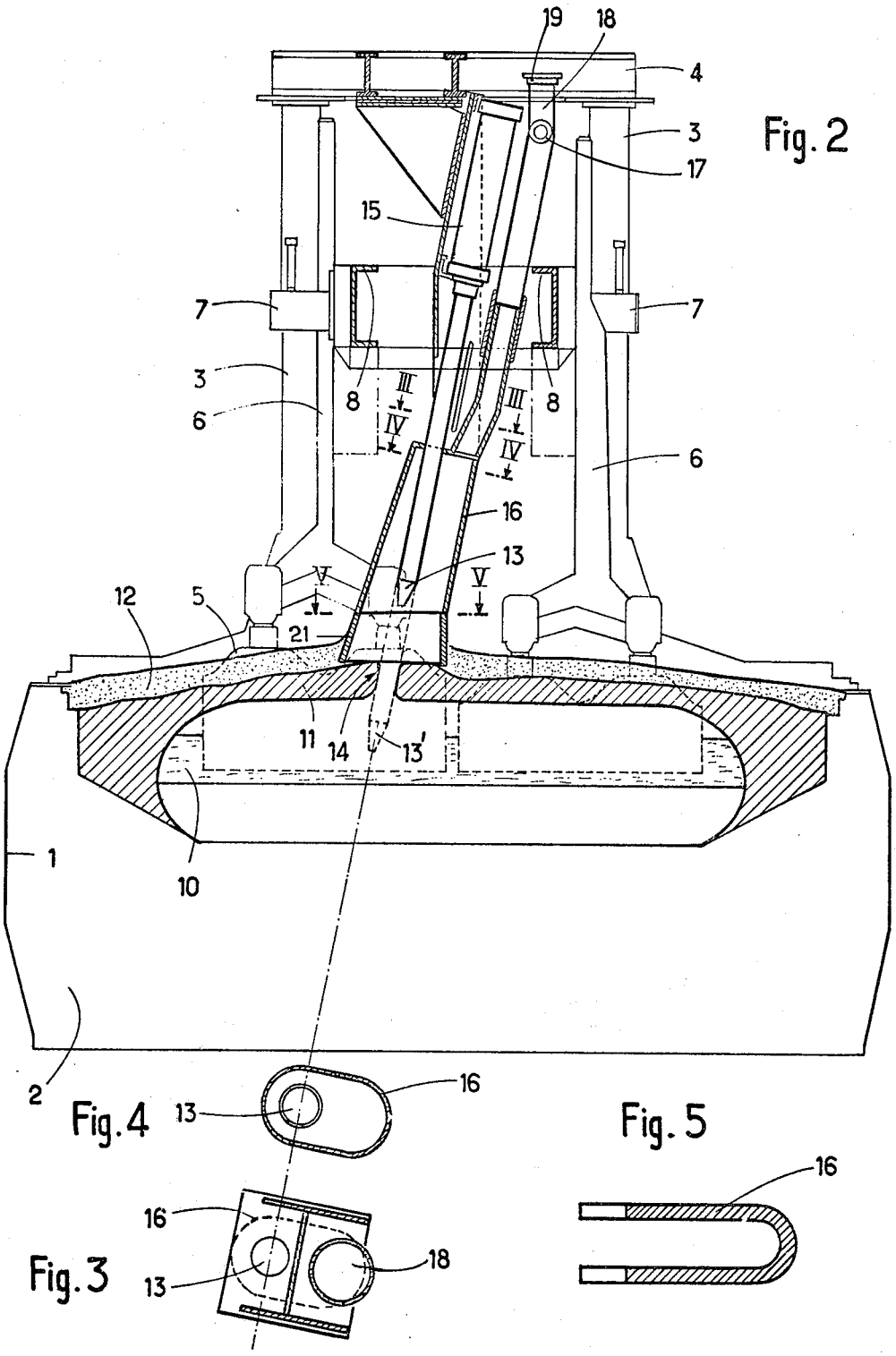
FIG. 2 is a section along line II of FIG. 1.
FIGS. 3, 4 and 5 are sections along III, IV and V of FIG. 2 respectively.

The tank illustrated in FIGS. 1 and 2 is made of a case or housing 1, the bottom 2 of which is composed of blocks of carbonated material assembled by means of metal rails; the bottom constitutes the cathode of the tank. The case 1 holds a superstructure consisting of vertical posts 3, supporting horizontal cross beams 4. The anodes consist of blocks 5 of preheated carbonated materials, attached in groups to vertical legs 6, that are in turn attached by means of clamps 7 to horizontal bars or channels 8 which support the anodes and supply them with electrical energy. The bars 8 are suspended from the horizontal beams 4 by conventional means not shown, similar to those described in French Patents Nos. 1,440,005 and 1,519,475, both under the name of Pechiney, Compagnie de Produits Chimiques et Electrometallurgiques, and connected by means of a hoop 9 to a source of supply of direct current.

The case of the tank contains an electrolytic solution 10 consisting of a mixture of cryolite and alumina, heated to a temperature ranging between approximately 950° and 1000°C by the passage of electric current between the anode and the cathode. The upper part of the solution solidifies, thereby forming a solid crust 11 which covers the solution and thermally isolates it. This solid crust is covered by powdered alumina 12. Periodically, an operator pierces the crust, thus causing part of the alumina that covers the crust to fall into the solution, then reforms the alumina layer.

A movable steel shaft 13 is installed between two anodes; the shaft has the purpose of piercing a hole 14 in the crust and of keeping it permanently open. This shaft is operated by means of a jack 15, preferably a pneumatic piston-cylinder unit; its raised position, shown by a continuous line, is marked 13, while its lowered position, shown by a dotted line, is marked 13'. The shaft 13 is placed inside a hood 16 tangent to the crust that collects the gases flowing out of the hole 14. The hood is connected at one end to a pipe 17 that collects the gas, and at the other end to a manifold 18 containing two openings, one of which 19 is used for cleaning, the other 20 for blowing compressed air, originating preferably from the exhaust of the pneumatic jack 15.

The assembly formed by the shaft 13 and the jack 15 must comply with rather precise specifications: the stroke of the shaft must be sufficiently long in its lowered position to pierce the crust completely and reach the solution, and, in its raised position, to be at a sufficient distance from the flame produced by the combustion of the combustible fraction of the gases, thus remaining at a relatively low temperature. Actually, when the shaft reaches the solution, a certain amount of electrolyte deposits and solidifies on it, and, if the shaft is not cooled, the layers may accumulate until they prevent the operation of the jack. If the shaft is sufficiently cooled, the solidified layer of electrolyte breaks up into dust, which constitutes an automatic method of cleaning. During tests, it was found that a stroke of the order of 50 cm represents a minimum. Too long a stroke is not harmful by itself, but, in certain plants, it may cause obstacles to the passage of bridges or service equipment.

In the preferred method, the jack is operated at regular intervals by any conventional control device, that may usefully operate the jacks of a whole series of tanks according to a single program. This ensures regular pulsations in the system of gas collectors, which maintain the powder in suspension and facilitate transport to the dust filtering equipment.

The compressed air purification device placed in the manifold 18 makes it possible to blow away the dust that has a tendency to deposit in the horizontal collector 17. This cleaning that is caused by the exhaust air blowing from the jack 15 takes place with the same frequency as the movements of such jack.

The hood may hermetically seal the hole made in the crust. However, experience shows that this method of operation entails two disadvantages: the cavity existing between the crust and the electrolytic tank is subjected to a vacuum, which results in increasing the emission of vapors, and, consequently, the amount of fluorine products consumed; at the same time as carbonic gas, the toxic carbon monoxide is collected, and it is then difficult to dispose of.

Figure 6:
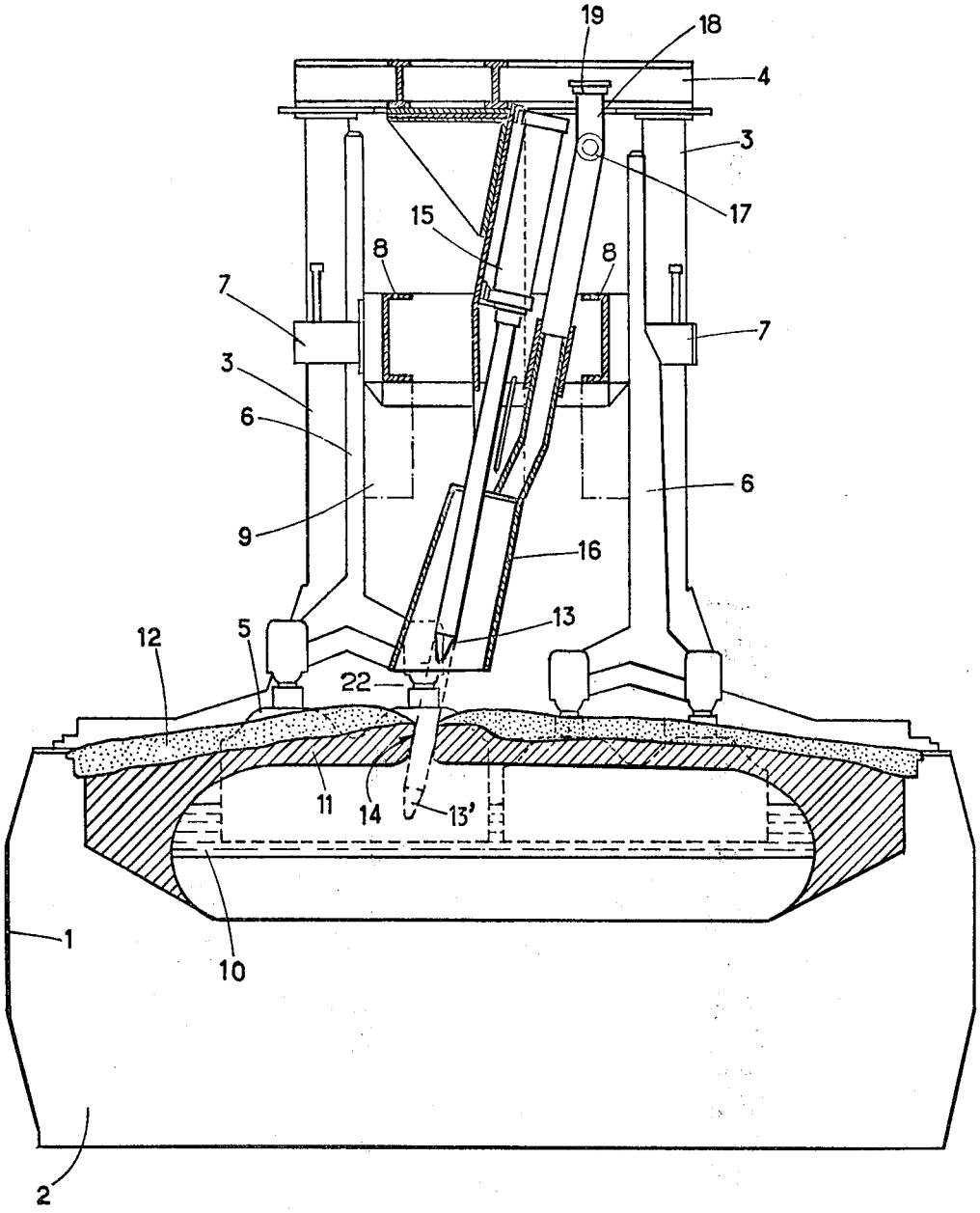
FIG. 6 represents an alternative form of the apparatus shown in FIG. 2.

In order to avoid these disadvantages, an air inlet is opened. This may consist of an opening 21 made in the wall of the lower part of the hood 16, as shown in FIGS. 2 and 5, or also in a raising of the hood, leaving an open space 22 between its lower edge and the crust, as shown in FIG. 6.

In this manner, on the one hand, the vacuum under the hood and, therefore, under the solid crust, is practically eliminated. On the other hand, the oxygen in the air that is introduced ensures the combustion of the carbon monoxide.

The apparatus above described makes it possible to collect over 80% of the gases in a highly concentrated form which makes it possible to obtain excellent efficiency in the recovery of the products. It may be used in conjunction with a traditional device for treating the atmosphere of the plant.

The apparatus envisaged by this invention may, of course, be combined with any other prior art collection device.

Its combination with a device for covering the tank, which is itself already known, also entails an additional advantage, because the air that is used to burn the combustible gases and to cool the system, being forcedly drawn under the cover, is itself already loaded with gases that would otherwise have escaped collection. Thus, a more concentrated gas is obtained, which is therefore easier to purify.

This invention applies to tanks for the production of aluminum by igneous electrolysis of alumina, and, more specifically, to tanks making use of preheated multiple anodes.

I claim:

1. A process for the collection of gases from a tank used in the production of aluminum by igneous electrolysis, comprising; piercing a hole in the crust which normally covers the electrolytic solution with a movable shaft, maintaining the hole thus formed in the crust open, maintaining a flow of at least coolant gas about the shaft in admixture with the gases emitted through said hole and collecting the released gases.

2. Apparatus for removing and collecting gases from an electrolytic solution in the production of aluminum by igneous electrolysis wherein the solution is in a tank and has a normal crust formed on and covering the same, comprising, a movable shaft means above said tank for penetrating the crust to form a hole therein and at least reach the solution and withdraw, means for automatically cleaning said shaft and including shaft moving means withdrawing said shaft a distance to permit solidification and disintegration of solution thereon, a fixed gas collecting hood supported above the area of the hole formed, gas outlet pipe means connected to said hood, and air inlet means adjacent to the lower end of the hood for maintaining a flow of at least coolant gas about said shaft.

3. Apparatus as defined in claim 2 wherein the air inlet means is an outlet hole in the lower part of said hood.

4. Apparatus as defined in claim 2 wherein the lower edge of the hood is adapted to be spaced above said crust, leaving an open space, said open space defining said air inlet means.

5. Apparatus as defined in claim 2 and further including a pneumatic jack for moving said shaft.

6. Apparatus as defined in claim 2 and further including inlet means for introduction of compressed air into said gas outlet pipe.

7. Apparatus as defined in claim 6, and further including a pneumatic jack for moving said shaft, said pneumatic jack having at least a compressed gas outlet, and means communicating said outlet with said inlet means.

* * * * *